US010948860B2

(12) United States Patent
Ikeno

(10) Patent No.: US 10,948,860 B2
(45) Date of Patent: Mar. 16, 2021

(54) FIXING DEVICE

(71) Applicant: Brother Kogyo Kabushiki Kaisha, Nagoya (JP)

(72) Inventor: Yuichi Ikeno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/918,020

(22) Filed: Jul. 1, 2020

(65) Prior Publication Data

US 2021/0003955 A1 Jan. 7, 2021

(30) Foreign Application Priority Data

Jul. 5, 2019 (JP) ..... JP2019-126450

(51) Int. Cl.
*G03G 15/20* (2006.01)

(52) U.S. Cl.
CPC ..... *G03G 15/2064* (2013.01); *G03G 15/2017* (2013.01); *G03G 15/2053* (2013.01)

(58) Field of Classification Search
CPC ..... G03G 15/2017; G03G 15/2053; G03G 15/2064
See application file for complete search history.

(56) References Cited

U.S. PATENT DOCUMENTS 10,481,536 B2 * 11/2019 Fujita ..... G03G 15/55
2002/0011476 A1 * 1/2002 Otsuka ..... G03G 15/2053 219/216
2013/0336672 A1 * 12/2013 Mizuta ..... G03G 15/2053 399/75
2015/0277309 A1 10/2015 Kuroda

FOREIGN PATENT DOCUMENTS

JP 2015-191734 A 11/2015

* cited by examiner

*Primary Examiner* — Gregory H Curran
(74) *Attorney, Agent, or Firm* — Burr & Brown, PLLC

(57) ABSTRACT

A fixing device includes: a substrate; an endless belt rotatable around the substrate; a heating pattern including a heating resistor provided on the substrate; a terminal electrically continuous to the heating pattern and provided at an end portion of the substrate in a longitudinal direction of the substrate; a connector including an electrode connected to the terminal, the connector being mounted to the end portion of the substrate from one side of the substrate in a widthwise direction of the substrate and engaged with the substrate in the longitudinal direction to restrict movement of the connector with respect to the longitudinal direction; and an engaging member mounted to the connector from the other side of the substrate in the widthwise direction and engaged with the substrate in the longitudinal direction to restrict movement of the engaging member with respect to the longitudinal direction.

19 Claims, 7 Drawing Sheets

FIXING DEVICE

CROSS REFERENCE TO RELATED APPLICATION

The present application claims priority from Japanese Patent Application No. 2019-126450, which was filed on Jul. 5, 2019, the disclosure of which is herein incorporated by reference in its entirety.

BACKGROUND

The following disclosure relates to a fixing device including a heater having a planar plate shape.

There is conventionally known a fixing device including: a heater having a substrate with a planar plate shape; and a connector and a connector engaging portion mounted to an end portion of the substrate in its longitudinal direction. Specifically, the connector and the connector engaging portion are mounted on the substrate such that the end portion of the substrate is held between the connector and the connector engaging portion in the widthwise direction of the substrate. The connector engaging portion is engaged with a recessed portion formed in one end of the substrate in the widthwise direction, thereby restricting movement of the connector relative to the substrate in the longitudinal direction.

SUMMARY

In the conventional technique, however, only the connector engaging portion is engaged with the substrate in the longitudinal direction, resulting in insufficient positioning of the connector in the longitudinal direction, leading to displacement of the connector relative to the substrate in the longitudinal direction, unfortunately.

Accordingly, an aspect of the disclosure relates to a fixing device capable of preventing displacement of a connector relative to a substrate in its longitudinal direction.

In one aspect of the disclosure, a fixing device includes: a substrate; an endless belt rotatable around the substrate; a heating pattern including a heating resistor provided on the substrate; a terminal electrically continuous to the heating pattern and provided at an end portion of the substrate in a longitudinal direction of the substrate; a connector including an electrode connected to the terminal, the connector being mounted to the end portion of the substrate from one side of the substrate in a widthwise direction of the substrate and engaged with the substrate in the longitudinal direction to restrict movement of the connector with respect to the longitudinal direction; and an engaging member mounted to the connector from the other side of the substrate in the widthwise direction and engaged with the substrate in the longitudinal direction to restrict movement of the engaging member with respect to the longitudinal direction.

In another aspect of the disclosure, a fixing device includes: a substrate; an endless belt rotatable around the substrate; a heating pattern provided for the substrate and including a heating resistor; a terminal electrically continuous to the heating pattern; and a connector including (i) an electrode connected to the terminal and (ii) a restrictor configured to restrict relative movement between the connector and the substrate in a longitudinal direction of the substrate in a state in which the terminal and the electrode are connected to each other.

In yet another aspect of the disclosure, a fixing device includes: a substrate; an endless belt rotatable around the substrate; a heating pattern provided for the substrate and including a heating resistor; a terminal electrically continuous to the heating pattern; a connector including an electrode connected to the terminal and a first engaging surface orthogonal to the longitudinal direction of the substrate; and an engaging member configured to be mounted to the connector including a second engaging surface orthogonal to the longitudinal direction of the substrate. The substrate includes a first engaged surface that faces the first engaging surface and a second engaged surface that faces the second engaging surface.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIGS. 5A and 5B are exploded perspective views illustrating the state in which the connector and the engaging member are removed from the substrate, wherein FIG. 5A is an exploded perspective view illustrating positions at which the connector and the engaging member are respectively engaged with the substrate, and FIG. 5B is a cross-sectional view illustrating the positions at which the connector and the engaging member are respectively engaged with the substrate;

EMBODIMENT

Figure 1:
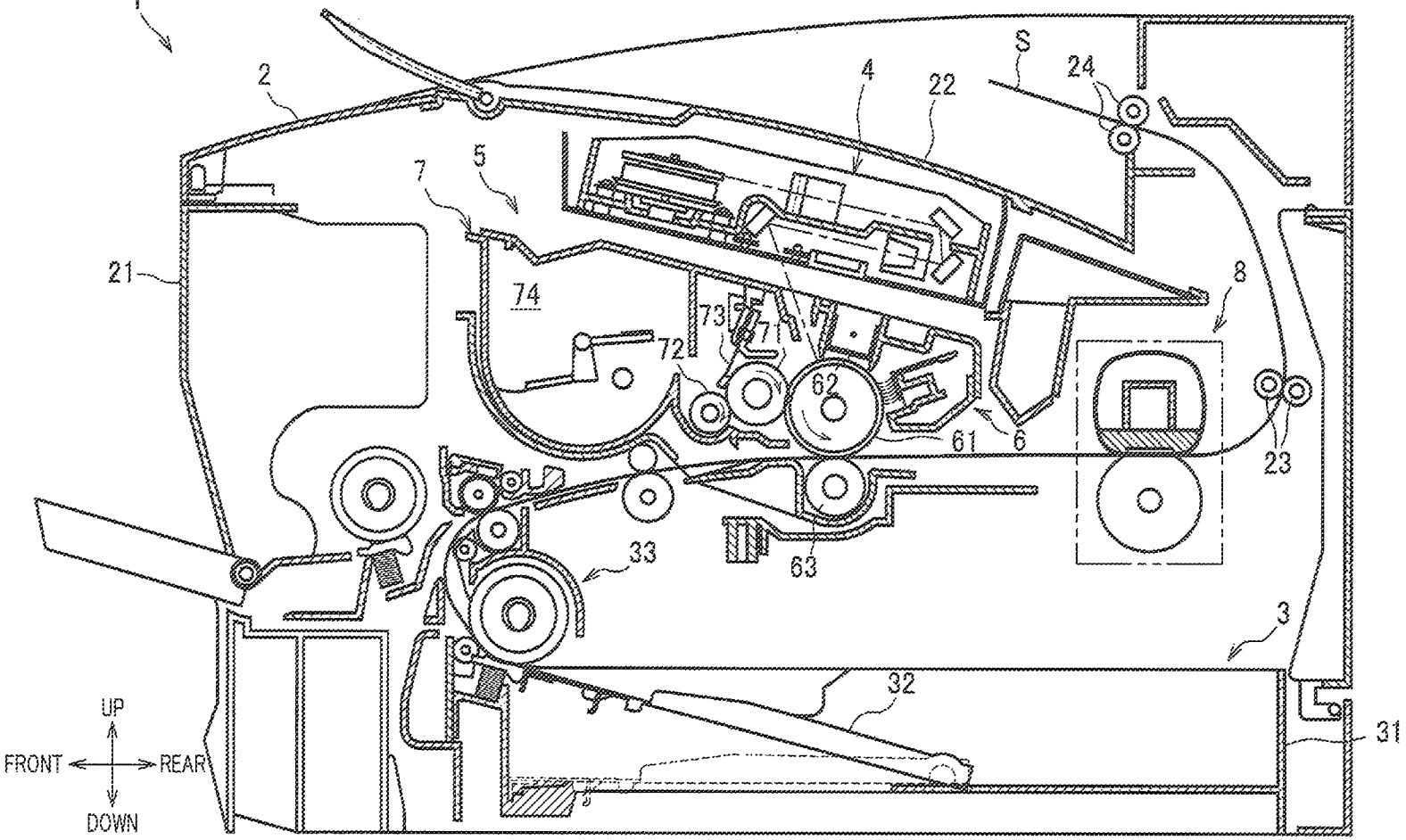
FIG. 1 is a cross-sectional view of a laser printer according to one embodiment.

Hereinafter, there will be described one embodiment by reference to the drawings. As illustrated in FIG. 1, a laser printer 1 includes a supplier 3, an exposing device 4, a process cartridge 5, and a fixing device 8 in a housing 2.

The supplier 3 is provided at a lower portion of the housing 2 and includes a supply tray 31 for accommodating sheets S, a pressing plate 32, and a supply mechanism 33. The sheet S accommodated in the supply tray 31 is moved upward by the pressing plate 32 and supplied into the process cartridge 5 by the supply mechanism 33.

The exposing device 4 is disposed at an upper portion of the housing 2 and includes a light source device, not illustrated, and a polygon mirror, a lens, a reflective mirror, and so on illustrated without reference numerals. The exposing device 4 exposes a surface of a photoconductor drum 61 by scanning the surface of the photoconductor drum 61 at high speed with a light beam emitted from the light source device based on image data.

The process cartridge 5 is disposed below the exposing device 4 and removably mountable in the housing 2 through an opening that is formed when opening a front cover 21 provided on the housing 2. The process cartridge 5 includes a drum unit 6 and a developing unit 7. The drum unit 6 includes the photoconductor drum 61, a charging unit 62, and a transfer roller 63. The developing unit 7 is mountable to and removable from the drum unit 6 and includes a developing roller 71, a supply roller 72, a layer-thickness limiting blade 73, and a container 74 containing toner.

In the process cartridge 5, the surface of the photoconductor drum 61 is uniformly charged by the charging unit 62 and then exposed by the light beam emitted from the exposing device 4 to form an electrostatic latent image on the photoconductor drum 61 based on the image data. The toner in the container 74 is supplied to the developing roller 71 by the supply roller 72 so as to enter a position between the developing roller 71 and the layer-thickness limiting blade 73, so that the toner is born on the developing roller 71 as a thin layer having a specific thickness. The toner born on the developing roller 71 is supplied from the developing roller 71 to the electrostatic latent image formed on the photoconductor drum 61. This visualizes the electrostatic latent image, thereby forming a toner image on the photoconductor drum 61. The sheet S is thereafter conveyed between the photoconductor drum 61 and the transfer roller 63, so that the toner image formed on the photoconductor drum 61 is transferred to the sheet S.

The fixing device 8 is disposed downstream of the process cartridge 5 in a conveying direction of the sheet S. The toner image is fixed while the sheet S to which the toner image is transferred is passing through the fixing device 8. The sheet S to which the toner image is fixed is discharged onto an output tray 22 by conveying rollers 23, 24.

Figure 2:
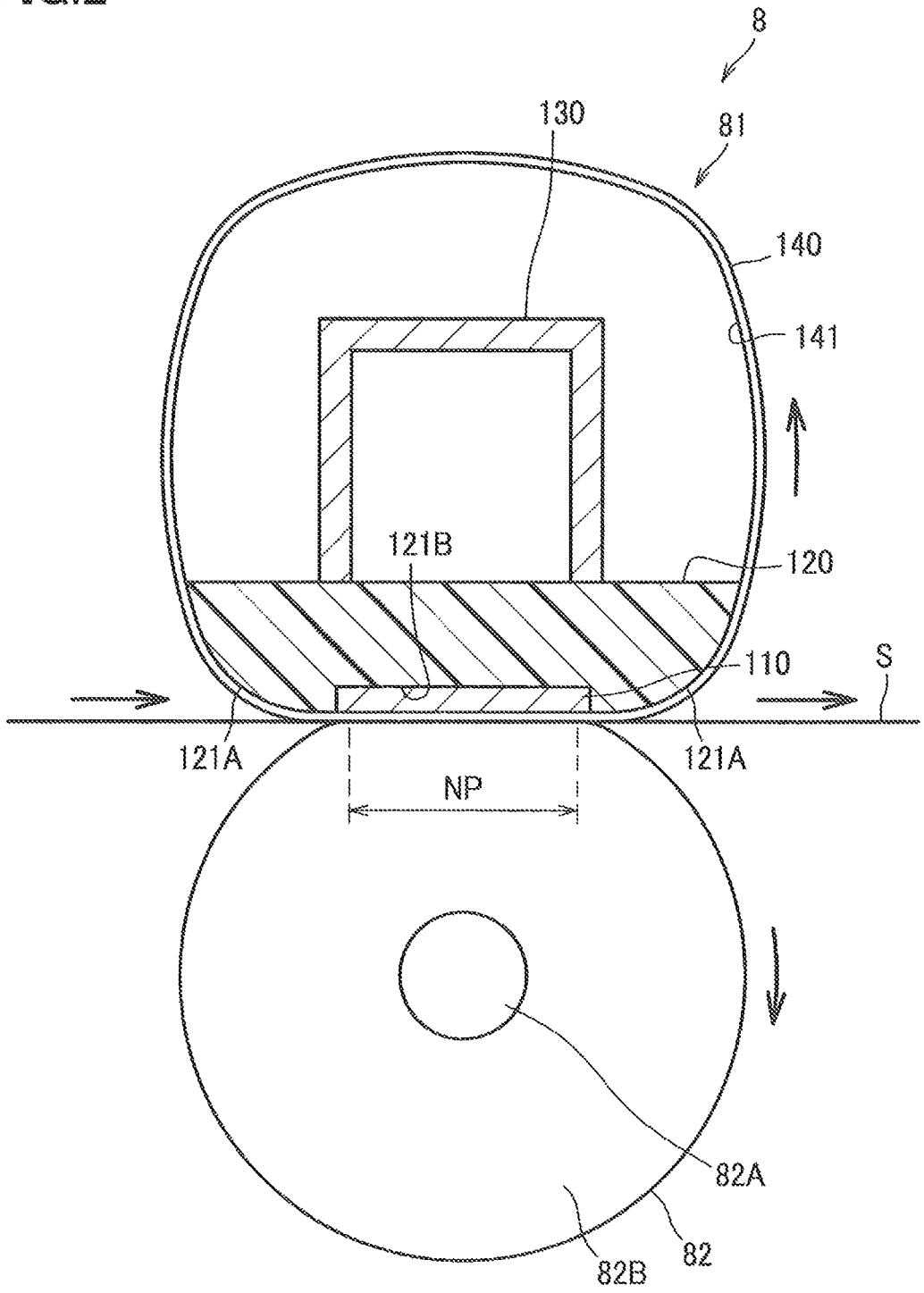
FIG. 2 is a cross-sectional view of a fixing device.

As illustrated in FIG. 2, the fixing device 8 includes a heating unit 81 and a pressure roller 82. One of the heating unit 81 and the pressure roller 82 is urged to the other by an urging mechanism, not illustrated.

The heating unit 81 includes a heater 110, a holder 120, a stay 130, and a belt 140. The heater 110 is of a planar plate shape and supported by the holder 120. It is noted that the configuration of the heater 110 will be described later in detail.

The holder 120 is formed of resin and has a guide surface 121A for guiding the belt 140 by contacting an inner circumferential surface 141 of the belt 140. The stay 130 is a member for supporting the holder 120 and formed by bending a plate member having stiffness greater than that of the holder 120, e.g., steel sheet, in a substantially U-shape in cross section.

The belt 140 is an endless belt having heat resistance and flexibility and including a metal raw tube formed of metal such as stainless steel, and a fluororesin layer covering the metal raw tube. The heater 110, the holder 120, and the stay 130 are disposed on an inner side of the belt 140. The belt 140 is configured to rotate around the heater 110, the holder 120, and the stay 130.

The pressure roller 82 includes a metal shaft 82A and an elastic layer 82B covering the shaft 82A. The belt 140 is nipped between the pressure roller 82 and the heater 110 to form a nip portion NP for heating and pressurizing the sheet S.

The pressure roller 82 is driven and rotated by a driving force transmitted from a motor, not illustrated, provided in the housing 2. When the pressure roller 82 is driven, the belt 140 is rotated by a frictional force between the pressure roller 82 and the belt 140 (or the sheet S). As a result, the sheet S to which the toner image is transferred is conveyed between the pressure roller 82 and the heated belt 140, whereby the toner image is heat-fixed.

Figure 3A:
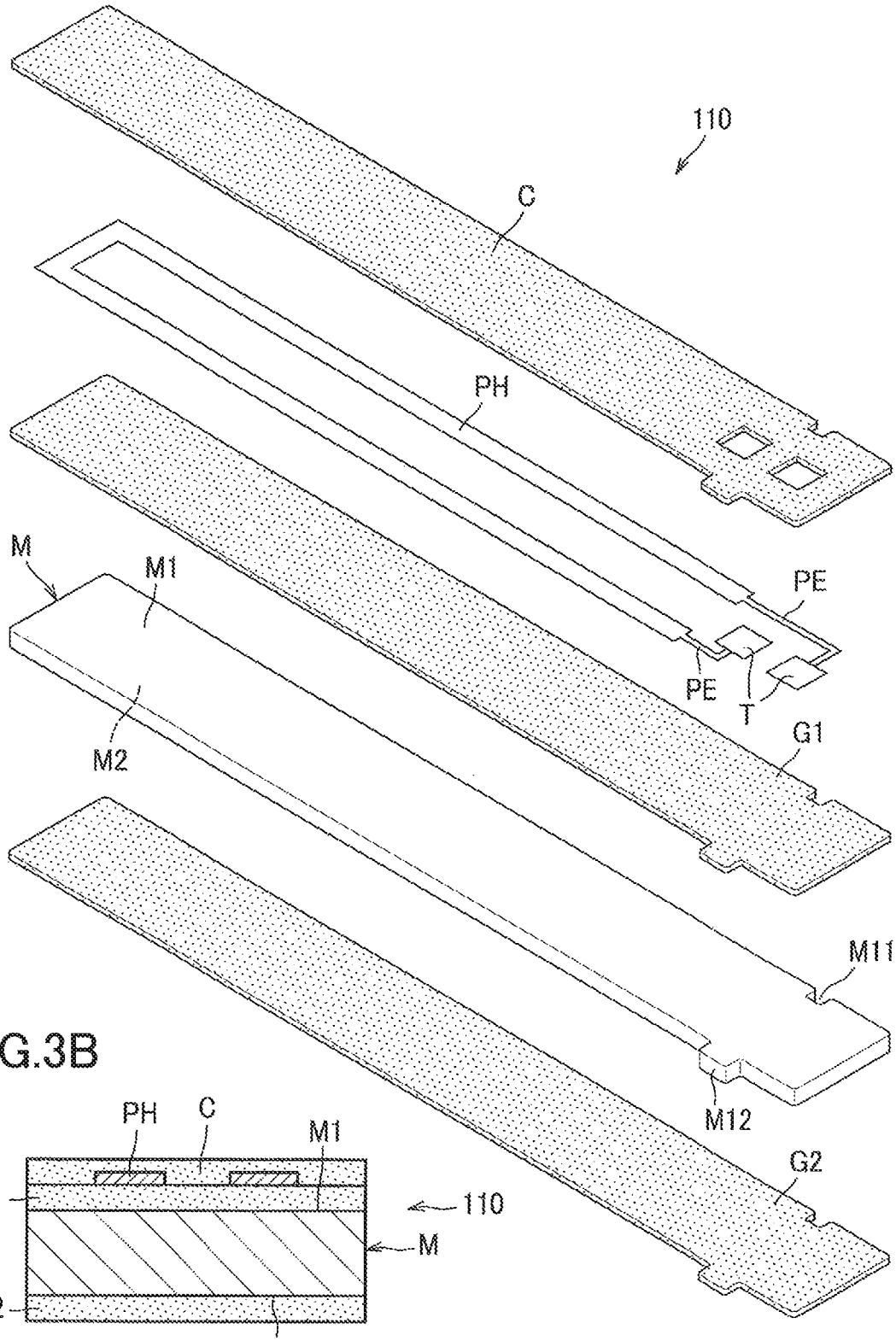
FIG. 3A is an exploded perspective view of a heater.
Figure 3B:
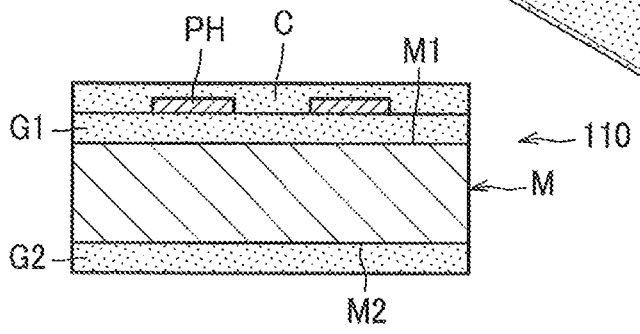
FIG. 3B is an exploded cross-sectional view of the heater.

As illustrated in FIGS. 3A and 3B, the heater 110 includes a substrate M, a first insulating layer G1, a second insulating layer G2, a heating pattern PH, a power-supply pattern PE, two terminals T, and a protecting layer C.

The substrate M is an elongated flat plate formed of metal such as stainless steel. The substrate M has a first surface M1 and a second surface M2 orthogonal to a direction in which the heating unit 81 or the pressure roller 82 urges. In the present embodiment, the heater 110 is disposed such that the first surface M1 of the substrate M faces toward the pressure roller 82.

The substrate M includes a recessed portion M11 as one example of a first engaging portion and a protruding portion M12 as one example of a second engaging portion. The recessed portion M11 and the protruding portion M12 are formed at one end portion of the substrate M in its longitudinal direction. In the following description, the longitudinal direction and the widthwise direction of the substrate M may be referred to simply as "longitudinal direction" and "widthwise direction", respectively. The longitudinal direction of the substrate M coincides with the direction of the rotation axis of the pressure roller 82, i.e., the direction in which the shaft 82A extends. The widthwise direction of the substrate M coincides with the conveying direction of the sheet S at the nip portion NP and with the direction in which the belt 140 moves at the nip portion NP.

The recessed portion M11 is engageable with a connector 200 (see FIG. 4) which will be described below to restrict movement of the connector 200 in the longitudinal direction. The recessed portion M11 is formed at one end portion of the substrate M in the widthwise direction and recessed in the widthwise direction.

The protruding portion M12 is engageable with an engaging member 300 (see FIG. 4) which will be described below to restrict movement of the engaging member 300 in the longitudinal direction. The protruding portion M12 is formed at the other end portion of the substrate M in the widthwise direction and protrudes in the widthwise direction.

Figure 5A:
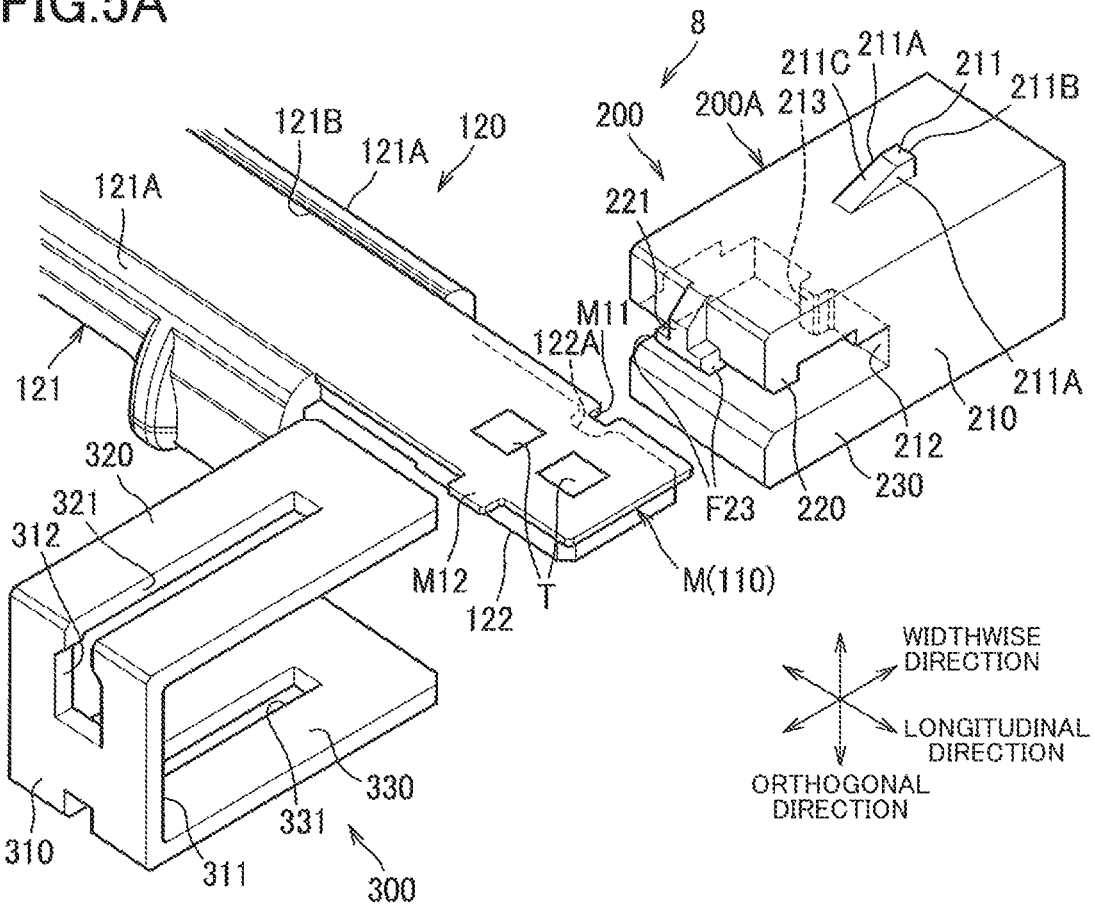
Figure 5B:
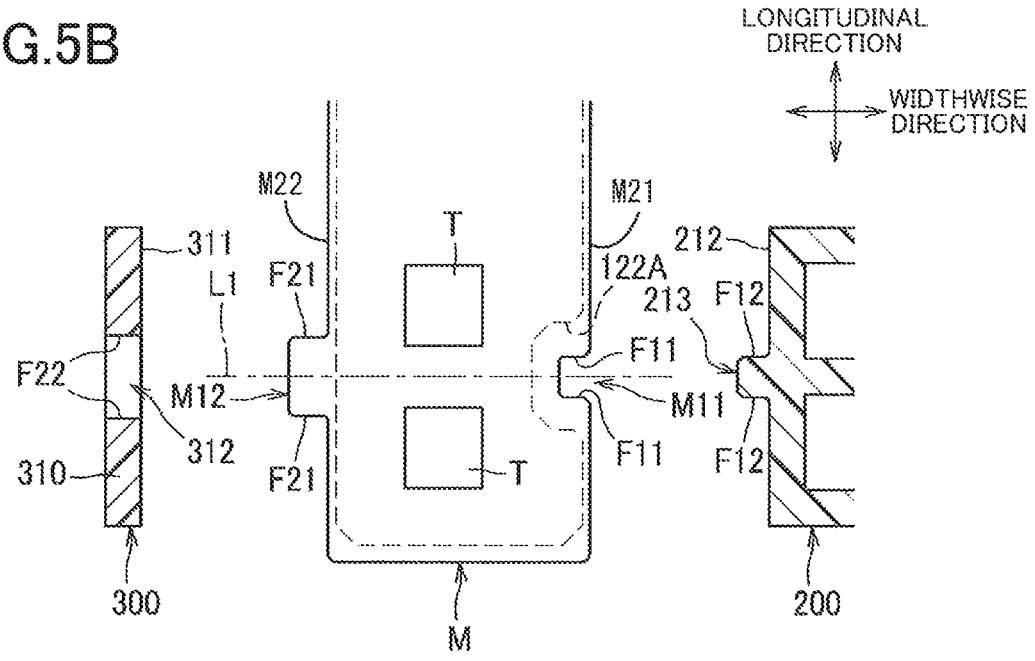

As illustrated in FIG. 5B, the recessed portion M11 and the protruding portion M12 are located on the same straight line L1 extending along the widthwise direction. The dimension of the protruding portion M12 in the longitudinal direction is greater than that of the recessed portion M11 in the longitudinal direction.

The recessed portion M11 is located within a region of the protruding portion M12 in the longitudinal direction. Specifically, the center of the recessed portion M11 in the longitudinal direction and the center of the protruding portion M12 in the longitudinal direction are located on the same straight line L1.

As illustrated in FIGS. 3A and 3B, each of the first insulating layer G1, the second insulating layer G2, and the protecting layer C is an insulating member formed of glass material, for example. The first insulating layer G1 is formed on the first surface M1 of the substrate M. The second insulating layer G2 is formed on the second surface M2 of the substrate M.

The heating pattern PH, the terminals T, and the power-supply pattern PE are formed on the first insulating layer G1. That is, the heating pattern PH, the terminals T, and the power-supply pattern PE are provided on the substrate M, with the first insulating layer G1 interposed therebetween.

The heating pattern PH is a heating resistor that generates heat when energized. In the present embodiment, the heating pattern PH has a U-shape extending along each of the end portions of the substrate M in the widthwise direction and the other end portion of the substrate M in the longitudinal direction.

Each of the terminals T is configured to supply electricity to the heating pattern PH. The two terminals T are provided at one end portion of the heater 110 in the longitudinal direction. Each of the terminals T is electrically continuous to the heating pattern PH via the power-supply pattern PE. Each of the terminals T is connectable to the connector 200 (see FIG. 4) which will be described below to be connected via the connector 200 to a power source, not illustrated, provided in the housing 2.

The power-supply pattern PE is a pattern for electrically connecting the terminals T and the heating pattern PH to each other. Each of the power-supply pattern PE and the terminals T is formed of a conductive material that is less than a material of the heating pattern PH in resistance value.

The protecting layer C covers the power-supply pattern PE and the heating pattern PH so as to expose the terminals T to the outside.

Figure 4:
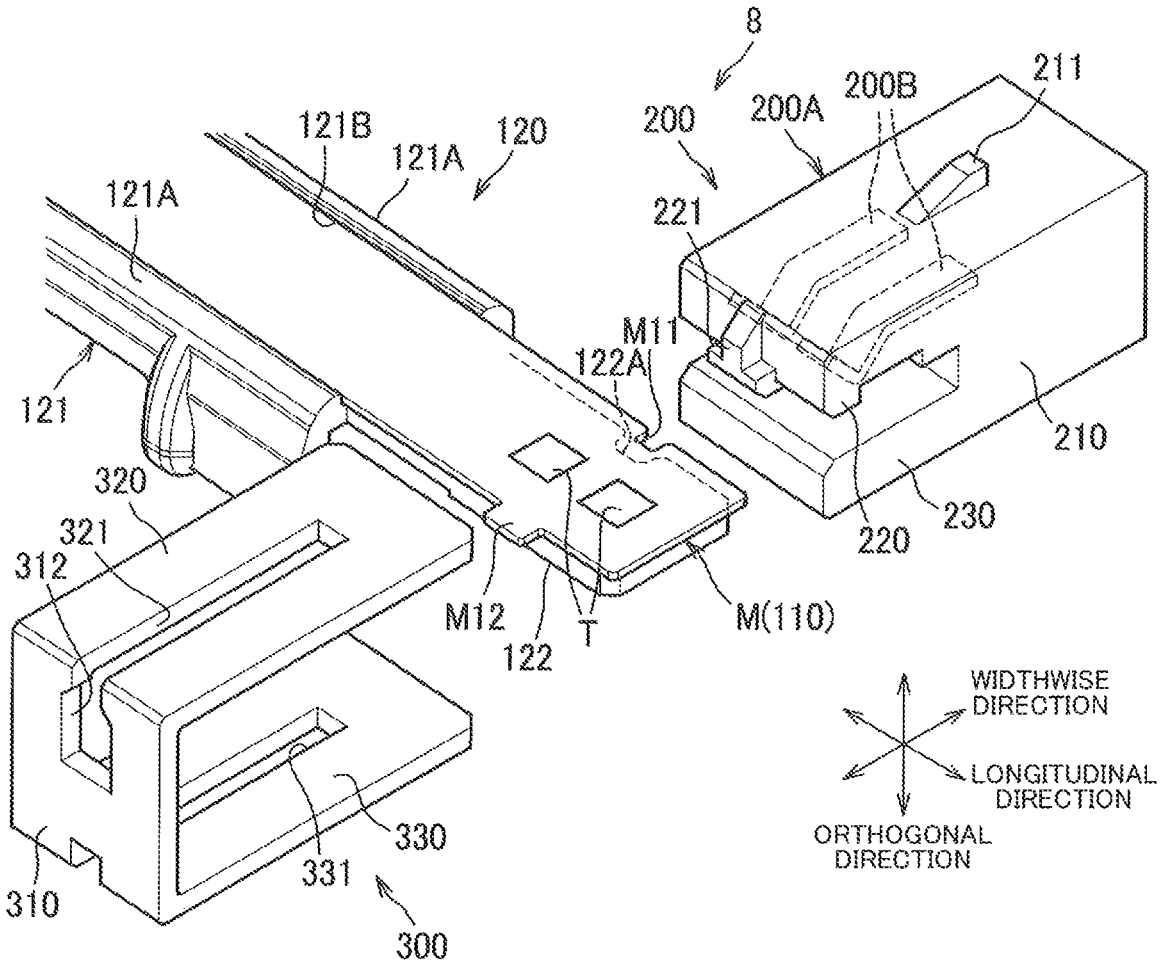
FIG. 4 is an exploded perspective view illustrating a state in which a connector and an engaging member are removed from a substrate, particularly illustrating a relationship between an electrode of the connector and terminals on a substrate.

As illustrated in FIG. 4, the fixing device 8 further includes the connector 200 and the engaging member 300. The construction of the holder 120 will be described before describing the constructions of the connector 200 and the engaging member 300.

The holder 120 includes a base portion 121 having the guide surface 121A, and an extending portion 122 extending outward from the base portion 121 in the longitudinal direction. The base portion 121 has a holding groove 121B (also see FIG. 2) for holding the substrate M. The holding groove 121B holds the substrate M in a state in which a bottom surface of the holding groove 121B faces one of opposite surfaces of the substrate M (the second surface M2 in the present embodiment).

The extending portion 122 has a surface flush with the bottom surface of the holding groove 121B. This surface supports the one end portion of the substrate M. The extending portion 122 includes a second recessed portion 122A overlapping the recessed portion M11 of the substrate M in an orthogonal direction that is a direction orthogonal to the first surface M1 of the substrate M. In the following description, the orthogonal direction orthogonal to the first surface M1 may be referred to simply as "orthogonal direction".

In other words, as illustrated in FIG. 5B, when projected in the orthogonal direction, the second recessed portion 122A overlaps the recessed portion M11. The dimension of the second recessed portion 122A in the longitudinal direction is greater than that of the recessed portion M11 in the longitudinal direction. The center of the second recessed portion 122A in the longitudinal direction and the center of the recessed portion M11 in the longitudinal direction are located on the same straight line L1.

Returning to FIG. 4, the connector 200 is mountable to the one end portion of the substrate M from one side of the substrate M in the widthwise direction. The connector 200 includes a connector body 200A formed of a material such as resin, and two electrodes 200B formed of a conductive material such as metal.

The electrodes 200B are connected to the respective terminals T of the heater 110 and spaced apart from each other in the longitudinal direction. The electrodes 200B are connected to the power source, not illustrated, respectively by wires, not illustrated.

The connector body 200A includes a base portion 210 having a rectangular parallelepiped shape, and a first extending portion 220 and a second extending portion 230 extending from the base portion 210 toward the engaging member 300. The base portion 210 includes first protrusions 211 (each as one example of a movement-restricting engaging portion) formed on end faces of the base portion 210 in the orthogonal direction. FIG. 4 illustrates only one of the first protrusions 211.

Figure 6A:
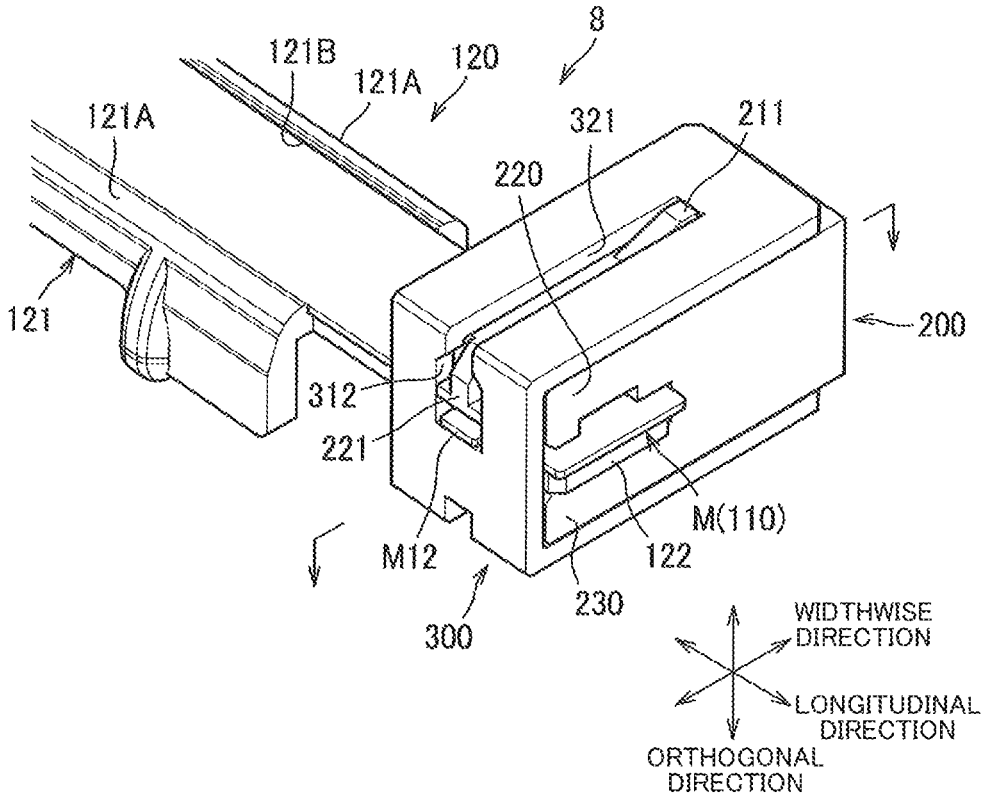
FIG. 6A is a perspective view illustrating a state in which the connector and the engaging member are mounted on the substrate.

The first extending portion 220 and the second extending portion 230 are spaced apart from each other in the orthogonal direction. The substrate M and the extending portion 122 of the holder 120 are held by and between the first extending portion 220 and the second extending portion 230 in the orthogonal direction in a state in which the connector 200 is mounted on the substrate M (see FIG. 6A).

A second protrusion 221 is provided on a distal end face of the first extending portion 220. As illustrated in FIG. 5A, the base portion 210 has a facing surface 212 as one example of a first facing surface and an engaged protrusion 213 as one example of a first engaged portion or a restrictor.

The facing surface 212 is an end face that faces a one-side end face M21 of the substrate M in the widthwise direction and that is disposed between the first extending portion 220 and the second extending portion 230 in the orthogonal direction. The engaged protrusion 213 is engageable with the recessed portion M11 of the substrate M in the longitudinal direction and protrudes from the facing surface 212 toward the substrate M.

Specifically, as illustrated in FIG. 5B, the recessed portion M11 of the substrate M has two first engaging surfaces F11 orthogonal to the longitudinal direction. The engaged protrusion 213 has two first engaged surfaces F12 that face the respective first engaging surfaces F11 in the longitudinal direction in the state in which the connector 200 is mounted on the substrate M (see FIG. 6B).

This engagement of the engaged protrusion 213 of the connector 200 with the recessed portion M11 of the substrate M restricts movement of the connector 200 with respect to the substrate M in the longitudinal direction. That is, the engaged protrusion 213 restricts the movement of the connector 200 with respect to the substrate M in the longitudinal direction by the engagement between the recessed portion M11 and the engaged protrusion 213 in the state in which the terminals T and the electrodes 200B are connected respectively to each other.

As illustrated in FIG. 5A, the engaging member 300 is mountable to the connector 200 from the other side of the substrate M in the widthwise direction. The engaging member 300 is formed of a material such as resin and includes a first wall 310, a second wall 320, and a third wall 330.

The first wall 310 includes a facing surface 311 as one example of a second facing surface and an engaged hole 312 as one example of a second engaged portion. The facing surface 311 is orthogonal to the widthwise direction and faces an other-side end face M22 of the substrate M in the widthwise direction.

The engaged hole 312 is engageable with the protruding portion M12 of the substrate M and the second protrusion 221 of the connector 200 in the longitudinal direction and formed through the first wall 310 in the widthwise direction. Specifically, as illustrated in FIG. 5B, the protruding portion M12 of the substrate M has two second engaging surfaces F21 orthogonal to the longitudinal direction. The engaged hole 312 has two second engaged surfaces F22 that face the respective second engaging surfaces F21 in the longitudinal direction in the state in which the engaging member 300 is mounted to the connector 200 (see FIG. 6B). Thus, engagement of the engaged hole 312 of the engaging member 300 with the protruding portion M12 of the substrate M restricts movement of the engaging member 300 with respect to the substrate M in the longitudinal direction.

It is noted that the second protrusion 221 of the connector 200 also has two engaging surfaces F23 that face the respective second engaged surfaces F22 of the engaged hole 312 in the longitudinal direction in the state in which the engaging member 300 is mounted to the connector 200. Engagement of the second protrusion 221 of the connector 200 with the engaged hole 312 of the engaging member 300 restricts movement of the connector 200 with respect to the engaging member 300 in the longitudinal direction. As a result, the connector 200 is directly engaged with the substrate M by the engaged protrusion 213 and indirectly engaged with the substrate M via the engaging member 300 by the second protrusion 221.

As illustrated in FIG. 5A, the second wall 320 extends from one end of the first wall 310 in the orthogonal direction toward the connector 200. The second wall 320 has a second engaged hole 321 (as one example of a movement-restricting engaged portion) engageable with one of the first protrusions 211 of the connector 200.

The second engaged hole 321 extends from the second wall 320 to the first wall 310 and continues to the engaged hole 312 of the first wall 310. The dimension of the second engaged hole 321 in the longitudinal direction is less than that of the engaged hole 312 in the longitudinal direction. The second engaged hole 321 extends through the first wall 310 and the second wall 320 in the thickness direction. The second engaged hole 321 is engaged with end faces 211A of the first protrusion 211 in the longitudinal direction and with a one-side end face 211B of the first protrusion 211 in the widthwise direction.

Here, the one-side end face 211B of the first protrusion 211 in the widthwise direction is orthogonal to the widthwise direction, and an other-side end face 211C of the first protrusion 211 in the widthwise direction is inclined such that an other-side portion of the other-side end face 211C is located on an inner side of a one-side portion of the other-side end face 211C in the orthogonal direction. Engagement of the second engaged hole 321 with the one-side end face 211B of the first protrusion 211 in the widthwise direction prevents detachment of the engaging member 300 from the connector 200 in the widthwise direction. That is, it is possible to consider that the engaging member 300 is a movement restricting member configured to restrict movement of the connector 200 relative to the substrate M in the widthwise direction of the substrate M by engagement of the second engaged hole 321 with the first protrusion 211 in the state in which the terminals T and the electrodes 200B are connected respectively to each other. Since the other-side end face 211C of the first protrusion 211 in the widthwise direction is inclined, it is possible to easily mount the engaging member 300 to the connector 200. It is noted that the above-described construction may be replaced with a construction in which a protrusion is formed on the engaging member 300, and an engaged hole is formed in the connector 200.

The third wall 330 extends from the other end of the first wall 310 in the orthogonal direction toward the connector 200. The third wall 330 has a third engaged hole 331 that is engageable with the other of the first protrusions 211 of the connector 200, not illustrated.

The third engaged hole 331 extends from the third wall 330 to the first wall 310 and is separated from the engaged hole 312 of the first wall 310. The dimension of the third engaged hole 331 in the longitudinal direction is equal to that of the second engaged hole 321 in the longitudinal direction. The third engaged hole 331 extends through the first wall 310 and the third wall 330 in the thickness direction. It is noted that the relationship between the third engaged hole 331 and the first protrusion 211 is the same as the relationship between the second engaged hole 321 and the first protrusion 211, and an explanation thereof is dispensed with.

In the engaging member 300, the engaged hole 312 is engaged with the second protrusion 221 of the connector 200 in the longitudinal direction as described above, and in addition the second engaged hole 321 and the third engaged hole 331 are engaged with the respective first protrusions 211 of the connector 200 in the longitudinal direction. This configuration better restricts the movement of the connector 200 with respect to the engaging member 300 in the longitudinal direction.

Figure 6B:
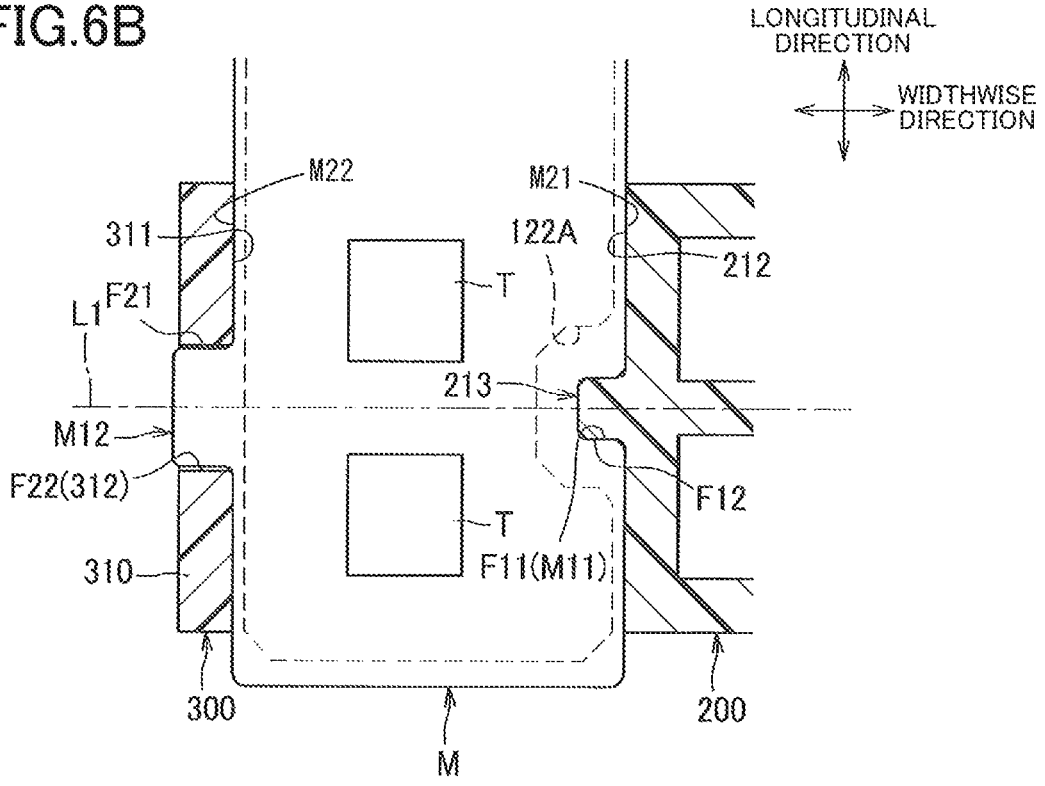
FIG. 6B is a cross-sectional view illustrating a state in which the connector and the engaging member are engaged with the substrate.

As illustrated in FIG. 6B, the substrate M is held by and between the facing surface 212 of the connector 200 and the facing surface 311 of the engaging member 300 in the widthwise direction in a state in which the engaging member 300 is mounted to the connector 200 mounted on the substrate M. This restricts movement of the connector 200 and the engaging member 300 with respect to the substrate M in the widthwise direction in the state in which the connector 200 and the engaging member 300 are engaged with each other.

There will be next described operations and effects of the fixing device 8 according to the present embodiment. When electricity is supplied to the heater 110 to perform printing, electricity is supplied to the heating pattern PH via the terminals T and the power-supply pattern PE to cause the heating pattern PH to generate heat. When the substrate M is thermally expanded in the longitudinal direction by heat generated by the heating pattern PH, the connector 200 and the engaging member 300 move in the longitudinal direction, following expansion of the substrate M. This configuration keeps the positional relationship between each of the electrodes 200B of the connector 200 and a corresponding one of the terminals T on the substrate M in FIG. 4, thereby well preventing the electrodes 200B from separating from the respective terminals T.

The coefficient of linear expansion of the substrate M formed of, e.g., metal is greater than the coefficient of linear expansion of the holder 120 formed of, e.g., resin. While the connector 200 is moved with respect to the holder 120 in the longitudinal direction in response to thermal expansion of the substrate M, as illustrated in FIG. 5B, the engaged protrusion 213 of the connector 200 is positioned in the second recessed portion 122A that is large in the longitudinal direction, thereby preventing interference between the connector 200 and the holder 120. That is, in the state in which the terminals T and the electrodes 200B are connected respectively to each other, the engaged protrusion 213 of the connector 200 restricts the movement of the connector 200 relative to the substrate M in the longitudinal direction of the substrate M by engagement of the recessed portion M11 with the engaged protrusion 213, and the engaged protrusion 213 allows movement of the connector 200 relative to the holder 120 in the longitudinal direction by movement of the engaged protrusion 213 in the second recessed portion 122A in the longitudinal direction. Accordingly, even in the case of thermal expansion of the substrate M, the connector 200 moves in the longitudinal direction, following the substrate M, making it possible to keep connection between the terminals T and the respective electrodes 200B.

The above-described configuration achieves the following effects. Both the connector 200 and the engaging member 300 mounted to the connector 200 are engaged with the substrate M in the longitudinal direction, thereby well preventing displacement of the connector 200 with respect to the substrate M in the longitudinal direction.

The first engaging portion of the substrate M which is engageable with the connector 200 is the recessed portion M11. Thus, when compared with a configuration in which both the first engaging portion and the second engaging portion are protruding portions, for example, it is possible to increase the number of the substrates M obtainable from a single plate member in the process of producing.

The first engaging portion is the recessed portion M11, and the second engaging portion is the protruding portion M12. This configuration results in high stiffness of the substrate when compared with a configuration in which both of the engaging portions are recessed portions, for example.

The dimension of the protruding portion M12 in the longitudinal direction is greater than the dimension of the recessed portion M11 in the longitudinal direction, thereby increasing the stiffness of the substrate M.

Movement of the connector 200 and the engaging member 300 with respect to the substrate M in the widthwise direction is restricted in the state in which the connector 200 and the engaging member 300 are engaged with each other, thereby preventing displacement of the connector 200 and the engaging member 300 with respect to the substrate M in the widthwise direction.

The substrate M is formed of metal, making it easy to process the substrate M when compared with a case where the substrate is formed of ceramic material, for example. This makes it easy to form the recessed portion M11 and the protruding portion M12.

Even in the case where the engaged protrusion 213 of the connector 200 which is engaged with the recessed portion M11 of the substrate M is moved in the longitudinal direction by thermal expansion of the substrate M in the longitudinal direction, following the substrate M, the engaged protrusion 213 moves in the second recessed portion 122A having a dimension greater than that of the recessed portion M11 in the longitudinal direction, thereby preventing interference between the engaged protrusion 213 and the holder 120.

While the embodiment has been described above, it is to be understood that the disclosure is not limited to the details of the illustrated embodiment, but may be embodied with various changes and modifications, which may occur to those skilled in the art, without departing from the spirit and scope of the disclosure. It is noted that the same reference numerals as used in the above-described embodiment are used to designate the corresponding elements of the following modifications, and an explanation of which is dispensed with.

Figure 7:
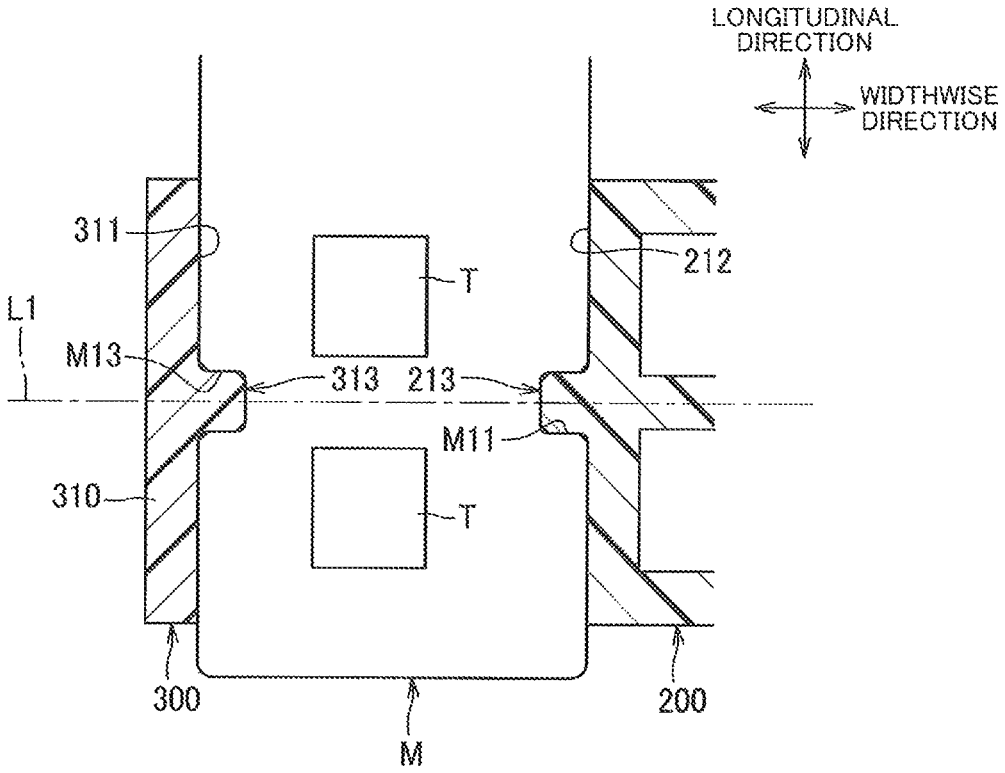
FIG. 7 is a cross-sectional view illustrating modifications of the substrate and the engaging member.

In the above-described embodiment, the first engaging portion engageable with the connector 200 is the recessed portion M11, and the second engaging portion engageable with the engaging member 300 is the protruding portion M12, but the present disclosure is not limited to this configuration. For example, the fixing device 8 may be configured such that the first engaging portion is a protruding portion, and the second engaging portion is a recessed portion. Alternatively, the fixing device 8 may be configured such that both the first engaging portion and the second engaging portion are protruding portions or recessed portions. It is noted that each of the first engaged portion and the second engaged portion needs to be a protruding portion or a recessed portion, depending upon the shapes of the first engaging portion and the second engaging portion. FIG. 7 illustrates a modification with different engaging portion and engaged portion.

In the modification illustrated in FIG. 7, the substrate M has a recessed portion M13 as another example of the second engaging portion. That is, the first engaging portion and the second engaging portion are the recessed portions M11, M13, respectively, in this modification. The engaging member 300 has a protruding portion 313 engageable with the recessed portion M13 of the substrate M. In this modification, the first engaging portion and the second engaging portion are the respective recessed portions M11, M13, making it possible to increase the number of the substrates M obtainable from a single plate member in the process of producing, when compared with a configuration in which the second engaging portion is the protruding portion M12 in the above-described embodiment, for example.

While the second engaged hole 321 continues to the engaged hole 312 in the above-described embodiment, the present disclosure is not limited to this configuration, and the second engaged hole 321 may be located apart from the engaged hole 312.

While the substrate M is formed of metal in the above-described embodiment, the present disclosure is not limited to this configuration. For example, the substrate M may be formed of an insulating material such as a ceramic material.

While the two terminals T are provided at the one end portion of the substrate M in the above-described embodiment, the present disclosure is not limited to this configuration. For example, the two terminals may be provided respectively at opposite end portions of the substrate. In this case, the connector and the engaging member at least need to be provided respectively at opposite end portions of the substrate. The terminals may be provided not at the end portions of the substrate but at positions located at a distance of a particular amount from the end portion toward a central portion of the substrate. The connector need not be mounted to the substrate from the one side of the substrate in the widthwise direction. Likewise, the engaging member need not be mounted to the substrate from the other side of the substrate in the widthwise direction. A restrictor different from the engaging member may be used to restrict movement of the connector relative to the substrate in the widthwise direction of the substrate. For example, a restrictor for restricting the movement of the connector relative to the substrate in the widthwise direction may be integrally formed on the connector. Specifically, it is considered that an engaging portion and an engaged portion are formed respectively at one and the other of the connector and the substrate, and the engaging portion and the engaged portion are engaged with each other to restrict movement of the connector relative to the substrate in the longitudinal direction and the widthwise direction of the substrate.

While the protecting layer C is provided in the above-described embodiment, the present disclosure is not limited to this configuration, and the protecting layer C may not be provided. That is, the heating pattern may contact the belt. The second insulating layer G2 may be omitted.

While the surface of the heater 110 on which the heating pattern PH is formed is in contact with the belt 140 in the above-described embodiment, the present disclosure is not limited to this configuration. For example, a surface of the heater 110 on which the heating pattern PH is not formed (a surface of the second insulating layer G2 in the above-described embodiment) may contact the belt 140. This case does not require the protecting layer C for facilitating sliding on the belt 140.

The elements in the above-described embodiment and the modifications may be combined as needed.

What is claimed is:

1. A fixing device, comprising:

a substrate;

an endless belt rotatable around the substrate;

a heating pattern comprising a heating resistor provided on the substrate;

a terminal electrically continuous to the heating pattern and provided at an end portion of the substrate in a longitudinal direction of the substrate;

a connector comprising an electrode connected to the terminal, the connector being mounted to the end portion of the substrate from one side of the substrate in a widthwise direction of the substrate and engaged with the substrate in the longitudinal direction to restrict movement of the connector with respect to the longitudinal direction; and an engaging member mounted to the connector from the other side of the substrate in the widthwise direction and engaged with the substrate in the longitudinal direction to restrict movement of the engaging member with respect to the longitudinal direction.

2. The fixing device according to claim 1, wherein the substrate comprises:

a first engaging portion engaged with the connector to restrict the movement of the connector in the longitudinal direction; and a second engaging portion engaged with the engaging member to restrict the movement of the engaging member in the longitudinal direction, wherein the connector comprises a first engaged portion engaged with the first engaging portion, and wherein the engaging member comprises a second engaged portion engaged with the second engaging portion.

3. The fixing device according to claim 2, wherein the first engaging portion comprises a first engaging surface orthogonal to the longitudinal direction of the substrate, wherein the first engaged portion comprises a first engaged surface that faces the first engaging surface, wherein the second engaging portion comprises a second engaging surface orthogonal to the longitudinal direction of the substrate, and wherein the second engaged portion comprises a second engaged surface that faces the second engaging surface.

4. The fixing device according to claim 2, wherein the first engaging portion is provided at a one-side end portion of the substrate in the widthwise direction, and wherein the second engaging portion is provided at an other-side end portion of the substrate in the widthwise direction.

5. The fixing device according to claim 2, wherein the first engaging portion and the second engaging portion are located on an identical straight line extending along the widthwise direction.

6. The fixing device according to claim 3, wherein at least one of the first engaging portion and the second engaging portion is a recessed portion that is recessed in the widthwise direction.

7. The fixing device according to claim 3, wherein one of the first engaging portion and the second engaging portion is the recessed portion, and the other of the first engaging portion and the second engaging portion is a protruding portion protruding in the widthwise direction.

8. The fixing device according to claim 7, wherein a dimension of the protruding portion in the longitudinal direction is greater than that of the recessed portion in the longitudinal direction.

9. The fixing device according to claim 1, wherein the connector comprises a first facing surface facing a one-side end face of the substrate in the widthwise direction, wherein the engaging member comprises a second facing surface facing an other-side end face of the substrate in the widthwise direction, and wherein the substrate is held by and between the first facing surface and the second facing surface.

10. The fixing device according to claim 1, wherein the substrate is formed of metal.

11. The fixing device according to claim 1, further comprising a holder opposed to a one-side surface of the substrate and holding the substrate, wherein the substrate and the holder are held by and between portions of the connector in an orthogonal direction orthogonal to the one-side surface of the substrate.

12. The fixing device according to claim 11, wherein one of the first engaging portion and the second engaging portion is a first recessed portion that is recessed in the widthwise direction, wherein the holder comprises a second recessed portion overlapping the first recessed portion when viewed in the orthogonal direction, and wherein a dimension of the second recessed portion in the longitudinal direction is greater than that of the first recessed portion in the longitudinal direction.

13. The fixing device according to claim 11, wherein the holder is configured to guide the endless belt while being in contact with an inner circumferential surface of the endless belt.

14. A fixing device, comprising:

a substrate;

an endless belt rotatable around the substrate;

a heating pattern provided for the substrate and comprising a heating resistor;

a terminal electrically continuous to the heating pattern;

a connector comprising (i) an electrode connected to the terminal and (ii) a first restrictor configured to restrict relative movement between the connector and the substrate in a longitudinal direction of the substrate in a state in which the terminal and the electrode are connected to each other; and a movement restricting member comprising a second restrictor configured to restrict relative movement between the movement restricting member and the substrate in the longitudinal direction of the substrate in a state in which the movement restricting member mounted to the connector.

15. The fixing device according to claim 14, wherein the first restrictor is a first engaged portion engaged with a first engaging portion of the substrate.

16. The fixing device according to claim 14, wherein one of the connector and the movement restricting member comprises a movement-restricting engaging portion, and the other of the connector and the movement restricting member comprises a movement-restricting engaged portion engaged with the movement- restricting engaging portion.

17. The fixing device according to claim 14, wherein the movement restricting member comprises a second engaged portion engaged with a second engaging portion of the substrate.

18. The fixing device according to claim 14, further comprising a holder configured to support the substrate with respect to the fixing device, wherein the first restrictor is configured to allow movement of the connector relative to the holder in the longitudinal direction of the substrate while restricting movement of the connector relative to the substrate in the longitudinal direction of the substrate in the state in which the terminal and the electrode are connected to each other.

19. A fixing device, comprising:

a substrate;

an endless belt rotatable around the substrate;

a heating pattern provided for the substrate and comprising a heating resistor;

a terminal electrically continuous to the heating pattern;

a connector comprising an electrode connected to the terminal and a first engaging surface orthogonal to the longitudinal direction of the substrate; and an engaging member configured to be mounted to the connector comprising a second engaging surface orthogonal to the longitudinal direction of the substrate, wherein the substrate comprises a first engaged surface that faces the first engaging surface and a second engaged surface that faces the second engaging surface.

* * * * *